US005271123A

United States Patent [19]

Teske

[11] Patent Number: 5,271,123

[45] Date of Patent: Dec. 21, 1993

[54] APPARATUS FOR CLEANING PORCELAIN ARTICLES, FOR EXAMPLE, THE HEADS OF DOLLS

[76] Inventor: Maria M. Teske, Hegelstr. 15, W-5000 Köln 90, Fed. Rep. of Germany

[21] Appl. No.: 884,748

[22] Filed: May 15, 1992

[30] Foreign Application Priority Data

May 18, 1991 [DE] Fed. Rep. of Germany ... 9106200[U]
Mar. 28, 1992 [DE] Fed. Rep. of Germany ... 9204233[U]

[51] Int. Cl.[5] ..... A47L 5/38

[52] U.S. Cl. ..... 15/310; 15/301; 15/303

[58] Field of Search ..... 15/301, 303, 310, 311

[56] References Cited

U.S. PATENT DOCUMENTS

| | | | |
|---|---|---|---|
| 1,053,227 | 2/1913 | Moritz | 15/303 X |
| 1,870,887 | 8/1932 | Bernhard | 15/310 |
| 2,779,046 | 1/1957 | Queirolo | 15/310 |
| 3,030,650 | 4/1962 | Kiraly | 15/310 |
| 3,066,345 | 12/1962 | Kasper | 15/310 |
| 3,216,043 | 11/1965 | Lipson | 15/310 |
| 4,594,747 | 6/1986 | Dempsey | 15/301 |

*Primary Examiner*—Chris K. Moore
*Attorney, Agent, or Firm*—Herbert Dubno

[57] ABSTRACT

An apparatus for cleaning porcelain workpieces such as cast dolls' heads has at least one work station having an opening in a workplate above a column communicating with that opening and provided with a support basket in which a filter bag is received. The suction duct communicates with the column below the filter bag and above a bottom plate to draw dust through said opening into the column for collection on the filter. The workplate can be separated from the column for replacement of the filter bag.

16 Claims, 3 Drawing Sheets

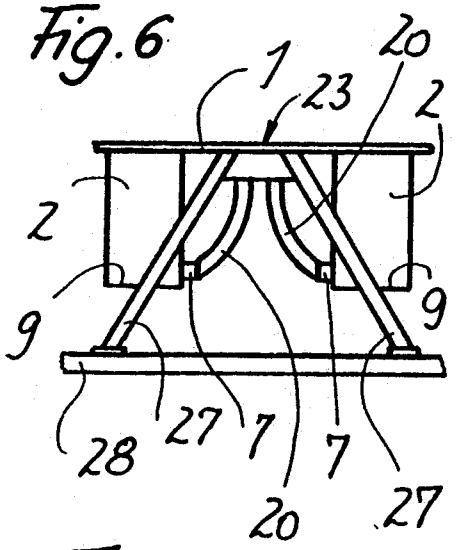
Fig. 6
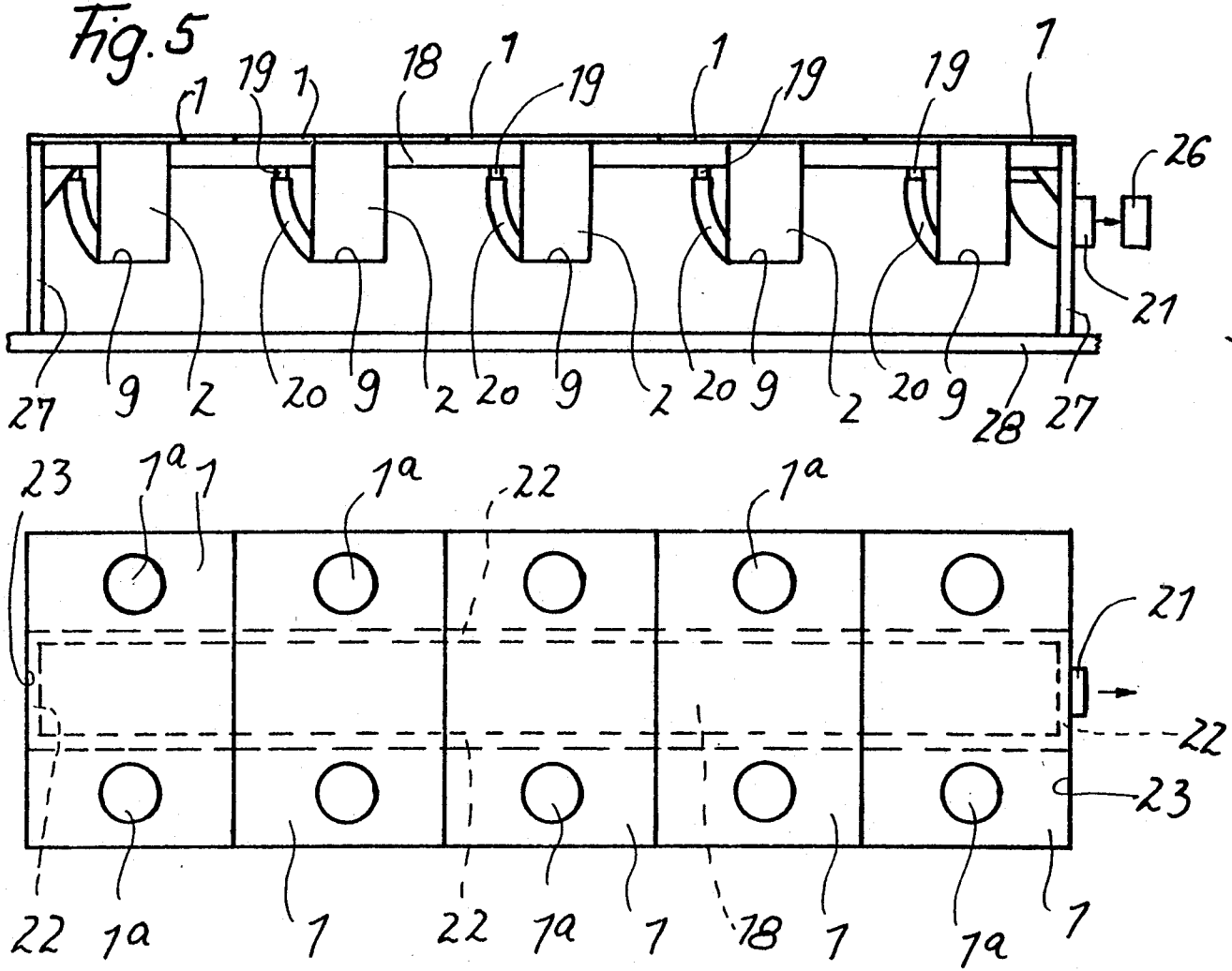
Fig. 5
Fig. 7

Fig. 8
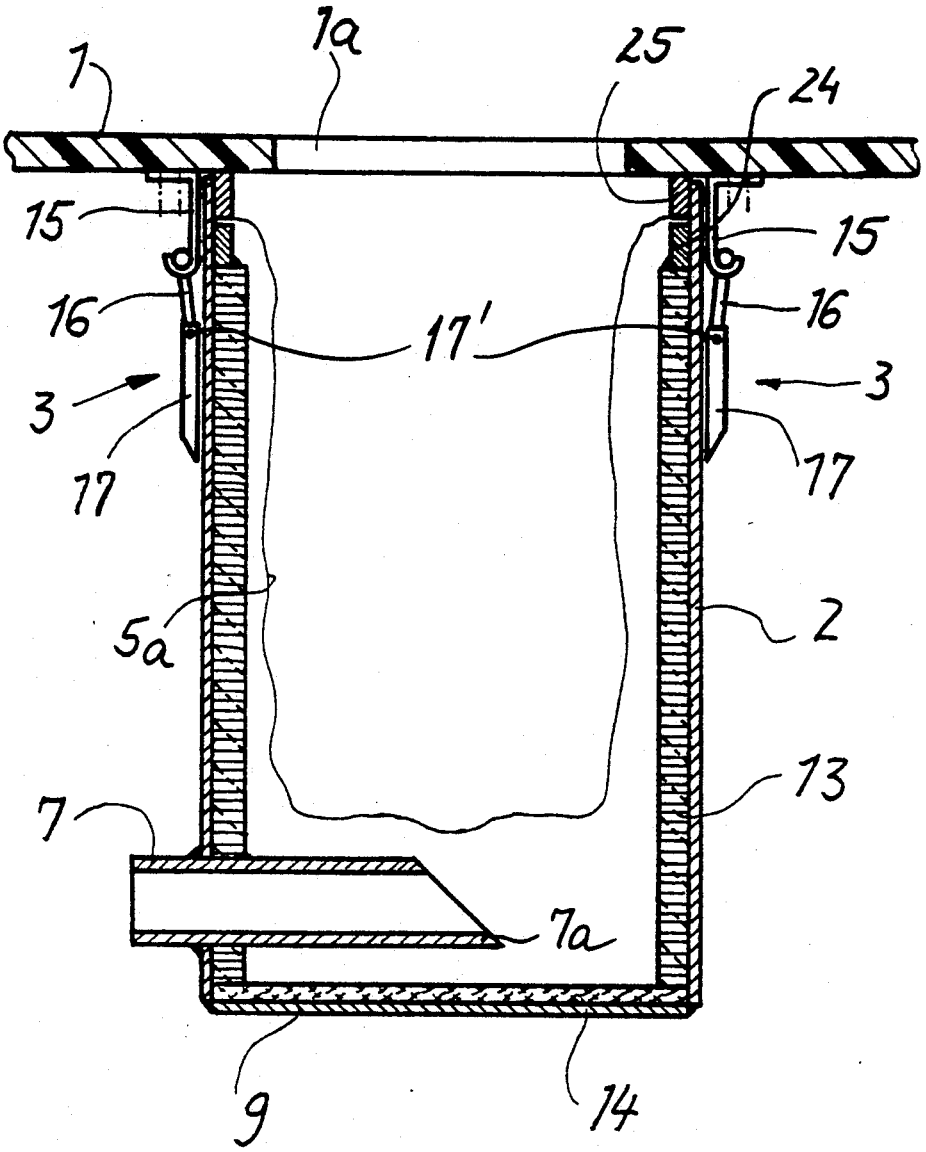
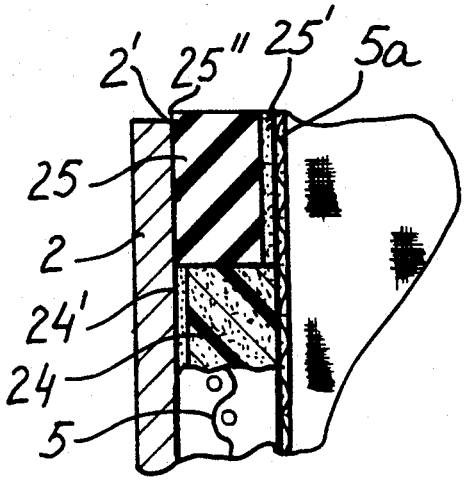
Fig. 9

APPARATUS FOR CLEANING PORCELAIN ARTICLES, FOR EXAMPLE, THE HEADS OF DOLLS

FIELD OF THE INVENTION

My present invention relates to an apparatus for the cleaning of porcelain articles or objects, such as cast porcelain objects like, for example, parts of dolls. More specifically, the invention relates to an apparatus providing a worktable and means at this worktable for maintaining a cleaning environment and a workplace free from silica dust when porcelain articles or objects are handles, for example, in the cleaning of dolls' heads after they have been fabricated by casting.

BACKGROUND OF THE INVENTION

Porcelain blanks are fabricated in the production of dolls by and large as cast articles which must be cleaned after solidification of the porcelain mass. In the cleaning process for such porcelain blanks, dust which is generally comprised of silica ($SiO_2$) is produced. This dust is detrimental to the health of the worker, contaminates surfaces in the region of the workplace and, in general, represents an environmental hazard or detriment.

OBJECTS OF THE INVENTION

It is, therefore, the principal object of the present invention to provide an improved apparatus which will obviate this drawback, i.e. allow the cleaning and finishing of a porcelain object, for example, a porcelain doll part, in which the detrimental effect of dust resulting from the cleaning or treatment process is suppressed.

Another object of the invention is to provide an apparatus or device for the purposes described which will reduce the possibility that the worker will inhale silica dust produced in the process of treatment of the porcelain article.

Another object of the invention is to provide an apparatus which affords at the workplace, reduced amounts of inhalable dust and also limits the tendency of dust to contaminate surfaces in the vicinity of the cleaning operation.

SUMMARY OF THE INVENTION

These objects are attained, in accordance with the invention, by providing a workplate on the top of which a worker can clean a porcelain workpiece, object or article, especially a cast porcelain object forming a part of a doll, and which is provided with an opening, preferably centrally of the workspace. This plate forming the table is connected to a bottom plate spaced below the table by a tubular wall defining a column opening upwardly through the aforementioned opening.

According to the invention, within the column, a dust filter and a support basket for this filter are provided and close to the bottom plate, a suction element is disposed for evacuating the interior of the column. The suction element can be a tube or pipe fitting which communicates with the interior of the column below the filter and above the bottom plate.

The term "support basket" is used here to refer not only to a basket-shaped structure, i.e. a structure made of a mesh or the like, but also to a fluid-permeable structure having fluid-permeable walls and a bottom and lining the wall of the column and the aforementioned bottom plate.

As has been noted earlier, the opening in the workplate is preferably located at the center of a workspace for the particular worker. When the worktable comprises a plurality of stations for respective workers, each station may be provided with a central opening. In a particularly advantageous embodiment of the invention, however, the column is freestanding on a support and carries the worktable for a single station and here, of course, the opening is located in the center of the upper plate.

The opening is preferably so dimensioned that it is slightly smaller than the porcelain workpiece, for example, the porcelain doll's head, which is being treated, i.e. cleaned, on the worktable. The opening is, most advantageously, circular. The upper plate or table serves to receive the blank during the cleaning operation and the user can hold the blank during this operation directly over the opening in the table. As a consequence, any dust resulting from the cleaning operation will be immediately drawn off through the opening, collected on the filter and removed from the environment.

Only clean air having traversed the filter will be released into the atmosphere.

It has been found to be advantageous to releasably mount the worktable or plate upon the column.

According to another feature of the invention, between the workplate and the mouth of the column, a sealing ring is provided, which can, if desired, be additionally used as a holder for the edge of the filter bag forming the filter received in the column.

In this configuration, the filter bag can project above the edge of the column to abut the underside of the worktable with its sealing ring and the worktable can be locked in position by a rapid-action locking device, such as a bayonet connection which permits rapid change of the dust filter or removal and replacement or emptying thereof.

The support basket can be a woven-wire basket having a bottom connected with its sides as previously noted. The purpose of the support basket, of course, is to provide support along the exterior of the filter bag which is filled from the underside by drawing air through it from within the column. This support prevents tearing of the filter bag and may be especially important at the bottom.

The suction element can be a tube or pipe section which traverses the wall of the column and is sealed thereto. With the column, the tube can have a beveled end terminating centrally of the column. The inclined mouth of the tube can thus register or be axially aligned with the opening in the workplace thereabove.

This has been found to constitute a simple way of applying a suction to the interior of the column centrally and to ensure a uniform dust extraction downwardly through the column. Since the tube is not bent or buckled and merely opens at a mouth inclined at, for example, 45°, a practically failure-free removal of the dust can be guaranteed. Dust does not tend to collect in any bend or kink of the pipe fitting to lead to obstruction.

Advantageously, moreover, the bottom plate is circular and the top or workplate is rectangular with small sides that are somewhat longer than the diameter of the circular column with long sides which are substantially twice this diameter.

It has been found to be advantageous to provide upwardly bent edges along the short sides of the worktable. Finally, mention should be made of the fact that the bottom plate is preferably flush with the column and that the column and the bottom plate, in turn, can be supported on a trolley formed by crossing arms provided with casters or other pivotally rollers at their free ends to enable the entire device to ride upon the floor.

As noted, previously, in another configuration of the invention, the support basket can be a filter mat which radially surrounds the filter bag and is supported in turn against the wall of the column. Such filter mats are conventional in the art and are commercially available.

Filter mats of this type can easily be bent to the round shape of the column and thus can be easily applied to the interior surfaces thereof. Because of the intrinsic stiffness of these air filter mats, they can be directly braced against the column plate of the column or simply positioned within the column to support the filter bag without having the filter mat collapse in the vertical direction.

These filter mats ensure that air will be withdrawn by the suction unit uniformly over the entire height of the column through the filter bag so that dust and other material falling through the opening can be efficiently collected in the filter bag.

It is preferred, according to the invention, to provide the tubular pipe close to the bottom plate and between the latter and the bottom of the filter bag.

In this manner I am able to achieve an especially effective air flow during the application of suction which has been found to be highly advantageous during the cleaning of porcelain workpieces to produce dolls or the like. The dust is positively collected in the filter bags.

For the purpose of sound damping, on the bottom plate or below the bottom plate, a mat of foam material is provided. In this manner the noise generated by suction can be damped or absorbed.

According to a feature of the invention, close to the mouth of the column on the inner side of the column wall, a strip, e.g. of a shape-retentive and hence relatively rigid foam material is adhered by an adhesive layer to provide a seat for a ring-shaped holder, preferably also a strip of shape-retentive foam material which is bonded to the exterior of the filter bag. The foam materials can be foamed plastic or foamed synthetic resin.

According to a feature of the invention, the holder strip can project slightly above the mouth of the column so that it can be sealingly engaged by and compressed by the workplate when the latter is attached to the column by the quick-release connection, previously described.

It will be apparent that this construction allows simple assembly of the device and mounting of the filter bag in place. To hold the filter bag and simultaneously seal the latter, therefore, it is only necessary to apply the self-adhesive strip to the inner wall of the column at a small spacing from the mouth of the opening and then to apply a similar holder to the filter bag utilizing self-adhesive strips in each case. The filter bag can thus be dropped into the opening of the column with the workplate or table removed and then the table mounted in place to secure the filter bag and, of course, form a seal between the workplate and the filter bag at the mouth of the column. The strips forming the seal are axially loaded and compressed to simultaneously seal the bag with respect to the column and with respect to the workplate around the opening thereof.

The quick-connect latches for securing the worktable to the column can be two in number and can be bail-type connectors disposed diametrically opposite one another so that the respective lever-acting bails can engage over hooks on the table and tensioned by the respective levers to lock the table in place.

Two pairs of such connectors can be provided and the table can then be formed with four hooks angularly equispaced about the respective opening in the worktable or upper plate. The hooks form guides or positioning elements for properly centering the table on the column or the column with respect to the table.

The rapid-acting connectors simplify the connection between the column and the worktable and enable the table to be easily released simply by swinging the levers of the respective latches into the unlocked positions.

In a particularly preferred embodiment of the invention, the table is provided with a plurality of workplaces or stations, each of which can be provided with a central opening and a respective column with its filter, support basket and evacuation pipe. This allows a plurality of workers to simultaneously clean the porcelain articles. A common suction source may be provided for all of the columns and this suction source can be a pipe running parallel to the table and parallel to the small sides of the upper plates forming the table. This suction duct can be mounted on the underside of the upper plate between two rows of openings defining work stations on opposite sides of the two plates.

Proximal to the openings, hoses or flexible conduits are provided to connect the pipe segments opening into each column with the suction duct running along the underside of the worktable.

At one longitudinal end, the latter may have a large cross-section fitting for connection to the suction source.

The suction source can be a duct of U-shaped cross section whose longitudinal edges are constituted by flanges and which can be secured to the underside of the table for, if desired, sealing elements. At the ends of the duct, head plates with appropriate suction fittings can be provided.

The duct may be a structurally stable member formed of sheet metal profiles and provide, with the support feet of the table, a stiff undercarriage to which the other elements of the apparatus are connected, namely, the plates and the columns.

When two stations at each workplate are provided opposite one another, the duct can pass centrally along the worktable and can be connected with the support plate only at ends of the latter.

With this construction, a greater or lesser number of work stations can be provided, corresponding to the length of the duct with the undercarriage supporting the workplates being formed solely by the aforementioned feet and duct. This provides an especially simple apparatus with a high degree of reliability.

BRIEF DESCRIPTION OF THE DRAWING

The above and other objects, features and advantages of the present invention will become more readily apparent from the following description, reference being made to the accompanying drawing in which:

FIG. 5 is a side elevational view of another embodiment of the apparatus;

FIG. 6 is an end view of this latter embodiment;

FIG. 7 is a top view thereof;

FIG. 8 is a cross sectional view through another embodiment of the fluid-permeable support for the filter bag; and FIG. 9 is a detail view showing the sealing of the filter bag in the column in axial section.

SPECIFIC DESCRIPTION

Figure 1:
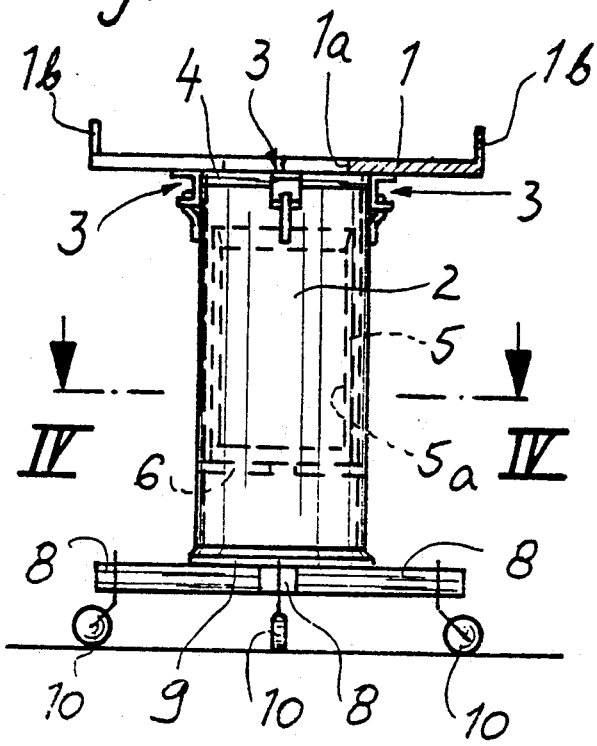
FIG. 1 is a side elevational view of an apparatus according to the invention, partly broken away.
Figure 2:
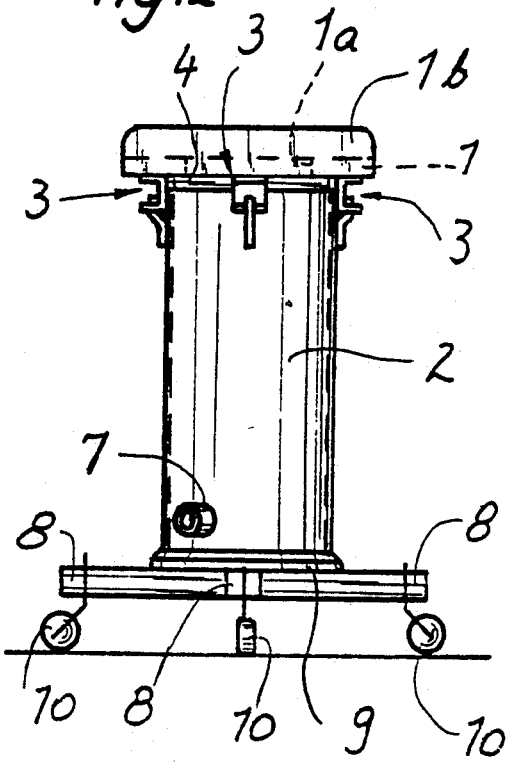
FIG. 2 is a view of the apparatus of FIG. 1 taken in a cross sectional plane at a right angle to the viewing plane of FIG. 1.
Figure 3:
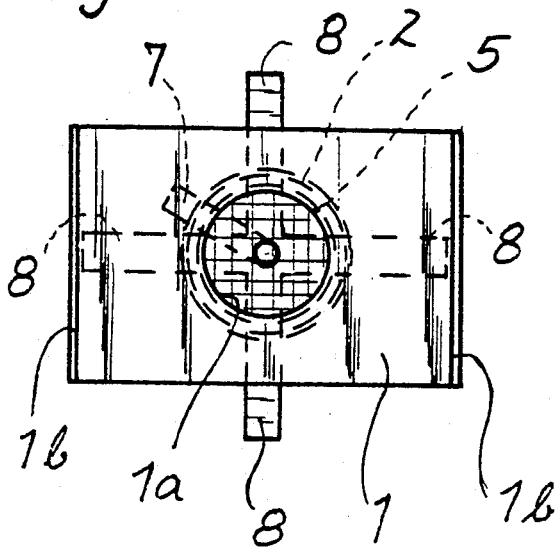
FIG. 3 is a top plan view of this apparatus.

FIG. 1 shows the apparatus of the invention in a first embodiment adapted to be shifted along the floor of the workplace and designed to provide a single station for the cleaning of porcelain dolls' heads or other porcelain doll parts formed, e.g. by casting.

A workplate 1 forms a worktable provided with a central opening 1*a*, a pair of upstanding flanges or ridges 1*b* on the small sides of the rectangular plate 1, a column 2 below this plate in alignment with the opening 1*a*, holding means for securing the plate 1 to the column, a sealing profile or strip 4, a basket 5 of woven wire, a filter bag 5*a* with a U-shaped sealing ring at the mouth, sound-absorbing material 6 under the bottom of the basket 5, a suction pipe 7 opening into the column 2 below the basket, support arms 8 upon which the column 2 is mounted, a bottom plate 9 closing the bottom of the column and swivelable casters 10 at the free ends of the arms 8.

Thus the column 2 is disposed between the bottom plate 9 and the top plate 1 which forms the worktable in registry with the opening 1*a*, a dust filter being provided within the column in the form of the filter bag 5*a* and its support basket 5 which can have a wall and a bottom of wire screen material. Close to the bottom plate 9, a suction source in the form of the pipe 7 opens into the column.

The members 3 are quick-release closures which may be a bayonet action or, as is preferred, a plurality of lever-and-bail devices which, as shown in FIG. 8, can have wire bails 16 engaging hooks 15 secured on the underside of the plate 1 and tensioned by swingable levers 17. When the levers 17 are swung upwardly about their respective pivots 17', the bails 16 can release the hooks 15.

Between the worktable 1 and the mouth of the column, a sealing ring 4 is provided which simultaneously serves as a holder for the upper edge of the dust filter 5*a*. The support basket 5 can be a wire mesh or woven-wire basket with a wire mesh or woven-wire bottom and the sound absorptive material 6 below the basket serves to reduce the noise produced by the apparatus when suction is applied to the pipe 7.

Of course, it is also possible to provide the column 2 externally with a sound-absorptive layer.

Figure 4:
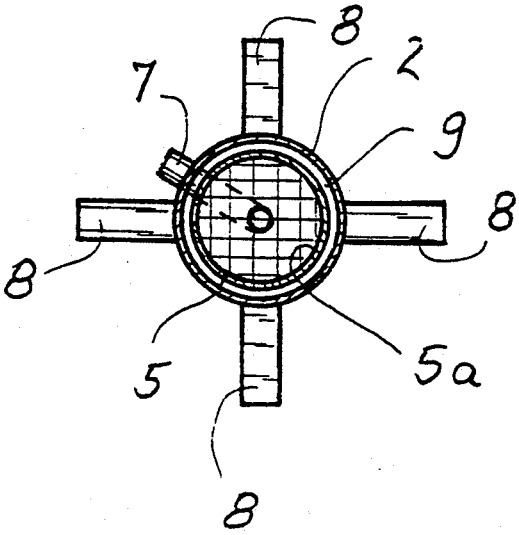
FIG. 4 is a cross sectional view of the apparatus taken along the line IV—IV of FIG. 1.

The mouth of the pipe 7 at its opening into the column is beveled and terminates centrally of the column as is especially apparent from FIGS. 4 and 8. The inclined opening of the mouth can register with the center of the opening 1*a* of the workplate or table.

The bottom late 9 is mounted, via the arms 8 on the swivelable casters 10 which are four in number. The bottom plate is circular and flush with the column 2.

The workplate or table 1, however, is rectangular with a small side somewhat longer than the diameter of the circular cross section column and a long side about twice as long as the diameter of the column 2.

At the small side edges of the plate 1, flanges 1*b* project away from the column.

The support casters 10 are swivelable on the undersides of the arms 8 which extend crosswise and radially below the plate 9 to which they are rigidly connected.

The height of the device from the floor to the upper surface of the worktable or plate 1 can be about 750 mm while the working plate or table can have dimensions of 400×600 mm. The inner diameter of column 2 can be about 260 mm while the opening diameter at 1*a* can be about 230 mm.

These dimensions have been found to provide a ergonomical construction which can allow the user to sit on a seat of normal height and clean the workpieces on the table or plate 1.

A variant of the system of FIGS. 1–4 is shown in FIGS. 5–7 and will be discussed in greater detail below.

Referring first to FIG. 9, it can be seen that the strip 24 of foamed plastic can be located above the basket 5 and can be anchored to the inner wall of the column 2 by an adhesive strip 24' of the contact or pressure-adhesive type. This strip forms an abutment for the foam rubber strip 25 which, with its adhesive strip 25', is bonded to the filter bag 5*a*.

As can be seen from FIG. 9, the edge 25'' of the strip 25 projects slightly above the mouth 1' of the column 2 so that it can be compressed by the plate 1 when the latter is applied to the column.

FIG. 8 shows a system in which the basket 5 has been constituted by an air filter mat 13 which radially surrounds the filter bag 5 and is braced externally against the inner wall of the column 2. The pipe 7 can extend through the wall of the column 2 at a location close to the bottom 9 which can be welded to the column and can be overlain by a sound-damping filter mat 14. The mouth of the pipe segment 7 thus lies within the pipe 2 between the bottom plate and the bottom of the filter bag 5*a* and is beveled at 7*a* with the center of the opening of the bevel opening aligned with the center of the opening 1*a*.

To fix the filter bag 5*a* on the column 2 in this embodiment, within the column 2 an annular holder 24 is provided which can be constituted from a strip of shape-stable foamed material which is provided with a self-adhesive layer on one side so that the strip can be simply bonded to the inner surface of the column in a simple manner.

The spacing of the holder 24 from the mouth of the column 2 is slightly less than the height (in axial direction) of a further holder 25 fixed at the mouth of the filter bag 5*a*. This holder 25 can also be formed, by way of example, from a strip of shape-stable foamed material which is self-adhesive on one side so that this strip can be bonded to the filter bag.

Here also, until the plate 1 is applied, the holder 25 will project by one to two mm above the mouth of the column 2. In that case, when the plate 1 is applied, the strip 25 is sealingly engaged and compressed, thereby both sealingly and mechanically fixing the bag 5 in place.

The workplate 1 can be provided with two diametrically opposite or two pair of diametrically opposite quick-connect closures as previously described which can cooperate with, for example, the four hooks 15. The closures 3 allow rapid removal of the plate 1 and consequent removal of the contaminated filter and its replacement, while nevertheless firmly securing the plate on the column.

As is especially apparent from FIGS. 5–7, each workplate 1 can be rectangular and can be provided with two openings 1*a* proximal to the respective small size. Within the respective columns 2, the dust filters 5*a* and support elements 5, 13 are provided around the respective filter 5*a*, the columns being closed by the bottom plates 9 and being formed with pipe segments 7.

Below and centrally of the table formed by the workplates 1, a suction duct 21 is provided and is connectable to a suction unit 26 such as an evacuating fan 16. The suction unit 26 has been illustrated only schematically and can be a conventional vacuum pump or the like.

The air duct 22 is U-shaped in cross section and has its longitudinal edges formed by upwardly-directed flanges fixed on the underside of the plates 1. The attachment can be effected by screws or other fastening means through the intermediary of a gasket seal. The ends of the duct 18 are closed by head plates 23. In the region of the head plates, corresponding seals are provided between the head plate and the workplate 1. At the ends of the duct 18, moreover, for example at the head plate 23, support feet 27 can be affixed upon which the apparatus is assembled.

In the embodiment of FIGS. 5–7, a plurality of such workplaces 1 are provided in continuous relationship and flush with one another so that the duct 18 can extend centrally along the underside of the plates 1 and can be closed by the plates 1 externally. The support feet 17 are welded to the duct 18. The duct 18 and the support plate 27 provide a stiff load supporting the undercarriage upon which workplates 1 are mounted.

Using five plates of this type, ten work stations can be provided with the free space below the plates 1 being occupied only by the columns 2 so as not to interfere with the feet of the workers. It will be understood, of course, that a greater or lesser number of work stations can be provided with corresponding changes in the length of the duct 18.

Hoses 20 connect the pipe segments 7 with the duct 18. If only three or four workplates or work stations are in use at any time, a plate can be applied to the workplate 1 to cover the openings 1*a* which are not used.

The invention is not, of course, limited to the specific embodiments described and illustrated but can be varied within the spirit and scope of the appended claims, all features of which are deemed to be inventive independently and in combination.

I claim:

1. An apparatus for the cleaning of porcelain workpieces, comprising:

a workplate formed with an opening and upon which a workpiece is to be cleaned;

a column extending downwardly from said workplate and communicating with said opening;

a bottom plate closing a bottom of said column;

a fluid-permeable support in said column;

a dust filter in said column surrounded by said support and supported thereby for collecting dust drawn into said column through said opening;

means communicating with said column close to said bottom plate for sucking air into said column through said opening;

means for releasably mounting said plate on said column at a mouth of said column;

a sealing ring at said mouth of said column sealing the interior of said column against said workplate, said sealing ring forming a holder for an edge of a filter bag forming said dust filter; and a holder in the form of a strip of shape-stable foamed material adhesively bonded to an inner wall of said column, said dust filter including a filter bag adhesively bonded to a strip of shape-stable foam material braced against the strip bonded to said column and projecting beyond the mouth of said column for engagement by said workplate.

2. The apparatus defined in claim 1 wherein said support is a support basket comprising a wire-screen wall and having a wire-screen bottom.

3. The apparatus defined in claim 1 wherein said means for sucking air into said column comprises a pipe segment traversing a wall of said column and having an end communicating with the interior of said column substantially centrally thereof, said end of said pipe segment being beveled to form a mouth aligned with a center of said opening.

4. The apparatus defined in claim 1, further comprising casters on said bottom plate for supporting said column.

5. The apparatus defined in claim 1 wherein said bottom plate is circular.

6. The apparatus defined in claim 1 wherein said workplate is rectangular and a small side of said workplate is somewhat longer than a diameter of said column while a long side of said workplate is substantially twice as long as said diameter, said column being circularly cylindrical.

7. The apparatus defined in claim 6, further comprising upwardly-turned flanges along small sides of said workplate.

8. The apparatus defined in claim 1 wherein said bottom plate is substantially flush with said column at the bottom thereof and is mounted on a carriage formed by arms disposed crosswise and provided at ends of said arms with support rollers.

9. The apparatus defined in claim 1 wherein said support is formed by a filter mat radially surrounding said dust filter and braced against an inner wall of said column.

10. The apparatus defined in claim 1 wherein said dust filter is a filter bag and said means for sucking air includes a pipe fitting extending through a wall of said column close to said bottom plate and between said bottom plate and said filter bag.

11. The apparatus defined in claim 1, further comprising a foam mat on said bottom plate.

12. The apparatus defined in claim 1 wherein said workplate is provided with a plurality of spaced-apart hooks and said column has at least one pair of diametrically opposite bail-and-lever rapid-action connectors engageable with said hooks.

13. An apparatus for the cleaning of porcelain workpieces, comprising:

a plurality of workplates adjoining one another, each of said workplates being formed with a respective pair of openings on respective opposite sides thereof and upon which a respective workpiece is to be cleaned;

a plurality of columns extending downwardly from respective workplates, each of said columns communicating with a respective pair of said openings;

a plurality of bottom plates, each of the bottom plates closing a respective bottom of one of the respective columns;

a plurality of fluid-permeable supports each mounted in a respective one of said columns;

a plurality of dust filters in said columns, each of said dust filters being surrounded by a respective one of said supports and being supported thereby for collecting dust drawn into the respective column through the respective pair of openings;

means communicating with each of the columns close to the respective bottom plates for sucking air into each of said column through the respective openings;

means for releasably mounting each of the plates on a respective column at a respective mouth of a column;

a plurality of sealing rings at respective mouths of said columns, each of said rings sealing a respective interior of a column against the respective workplate, the respective sealing ring forming a respective holder for a respective edge of a respective filter bag forming the respective dust filter, the means for sucking air including a duct extending along an underside of said workplates between the openings thereof and connected to a suction source, said duct being connected to each of said plurality of columns between the respective bottom plates and the respective dust filters.

14. The apparatus defined in claim 13 wherein said duct has a U-shaped cross section with longitudinal flanges sealingly secured to the undersides of said workplates and closed at opposite ends by respective head plates.

15. The apparatus defined in claim 14, further comprising support feet connected to said head plates and supporting said workplates and said duct.

16. The apparatus defined in claim 15 wherein a multiplicity of said workplates are provided and said feet are only connected to said plates at ends of said duct, said duct spanning all of said workplates.

* * * * *